United States Patent [19]

Demiere

[11] 4,339,855

[45] Jul. 20, 1982

[54] WEB-SPREADING ROLLER

[75] Inventor: Armand Demiere, Epalinges, Switzerland

[73] Assignee: Arcomac S.A., Lausanne, Switzerland

[21] Appl. No.: 788,882

[22] Filed: Apr. 19, 1977

[30] Foreign Application Priority Data

Apr. 30, 1976 [CH] Switzerland ..... 5435/76

[51] Int. Cl.[3] ..... D06C 3/06

[52] U.S. Cl. ..... 26/103; 162/271

[58] Field of Search ..... 26/99, 101, 103, 104; 29/116 R, 116 AD; 162/271

[56] References Cited

U.S. PATENT DOCUMENTS

| | | | |
|---|---|---|---|
| 868,098 | 10/1907 | Kiernan | 26/103 |
| 1,186,643 | 6/1916 | Anthony | 26/103 |
| 3,757,399 | 9/1973 | Hanssen | 29/116 R |

FOREIGN PATENT DOCUMENTS

| | | | |
|---|---|---|---|
| 2423797 | 11/1975 | Fed. Rep. of Germany | 26/101 |
| 2636868 | 3/1977 | Fed. Rep. of Germany | 26/103 |
| 6603231 | 9/1966 | Netherlands | 26/99 |
| 59654 | 4/1912 | Switzerland | 26/99 |
| 84434 | 3/1920 | Switzerland | 26/99 |
| 461419 | 10/1968 | Switzerland | 26/103 |

*Primary Examiner*—Robert Mackey

*Attorney, Agent, or Firm*—Young & Thompson

[57] ABSTRACT

The invention relates to a roller with rotatable sleeves in which each sleeve has, seen from above, a trapezoidal shape; they are mounted and idle on a central shaft in such a way that the large side of a sleeve is aligned with the small side of the adjacent sleeve; in which the sleeves are fastened to each other in this position for their rotation on the central shaft.

10 Claims, 7 Drawing Figures

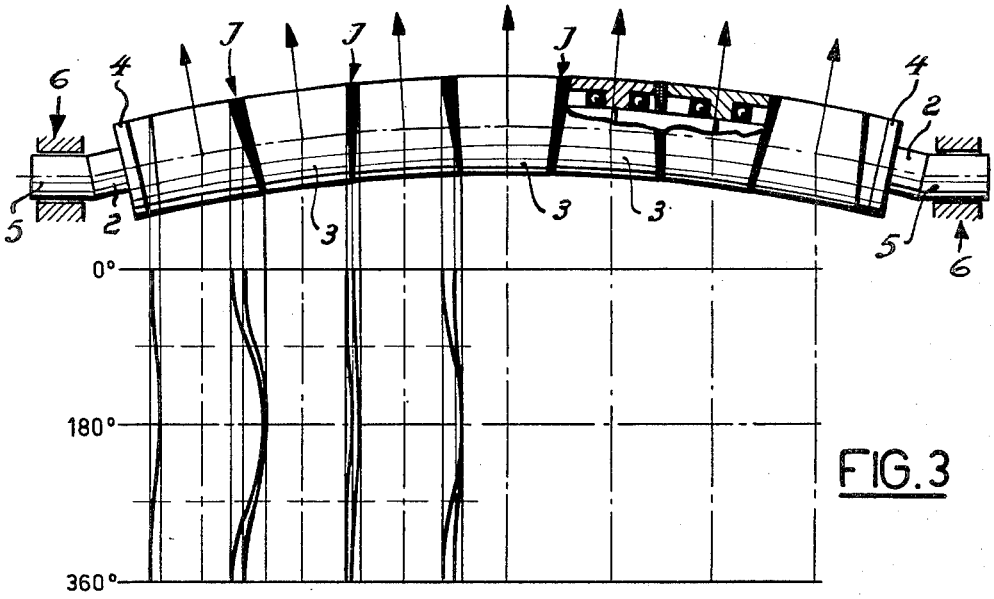
FIG. 3
FIG. 4
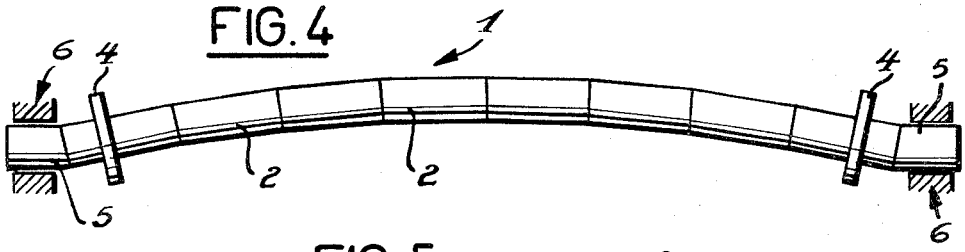
FIG. 5
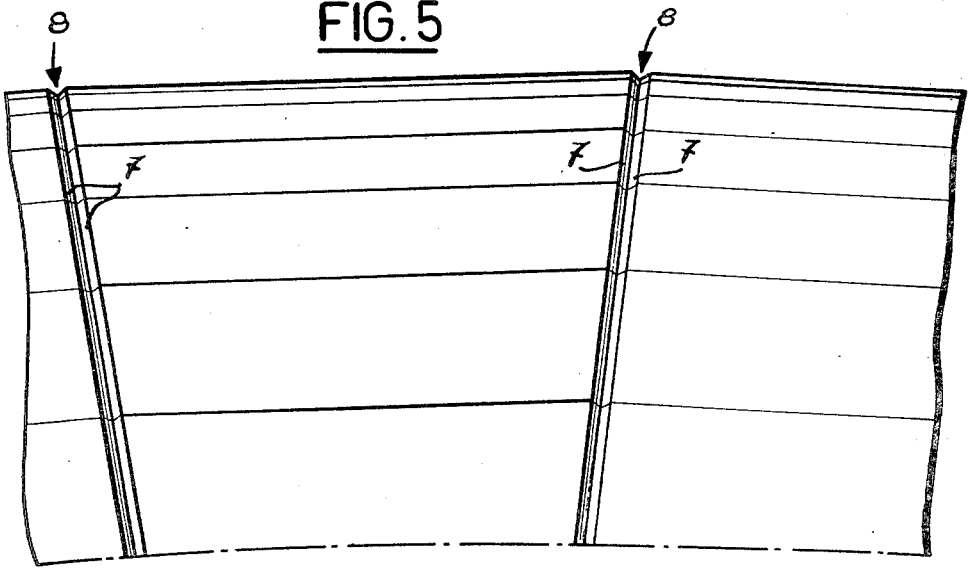

WEB-SPREADING ROLLER

The present invention has for its object the provision of a roller, particularly a web-spreading roller intended to be used in all industries where continuous sheets are manufactured. These web-spreading or arched rollers are used to avoid the folds which can form in the bands or belts of different widths which move continuously at speeds varying between 1 m/min and 3,000 m/min. During its passage over the roller the band which is dry or wet, of fabric, paper or plastic material, tends to shrink laterally, due to its longitudinal tension, and thus to form undesirable folds in the longitudinal direction.

To avoid this risk, it is necessary to apply divergent forces to the band which tend to stretch uniformly the band over all its width towards the edges.

FIGS. 1 and 2 show schematically and by way of example one type of conventional roller now used. These arcuate rollers are generally formed by a central shaft made in one piece out of steel, arched by means of a press to give it the necessary curvature. It is evident that a shaft which has been machined circular when straight will become slightly oval during the curving operation. This shaft is fixed; only the outside part is rotatable, driven by the continuous band which rests on the roller over a given enveloping angle. The rotative part may be driven by friction through the band itself or by means of a separate motor or any other means. In this case, the speed of the roller has to be precisely adapted to the speed of the endless band.

The rubber sleeve has to:

1. smooth the straight portions of the polygon;
2. connect the rotatable rings by covering the voids formed in the convex portion, voids which will mark the endless band with longitudinal traces;
3. stretch the endless band.

The rubber sleeve is often subjected to severe wear, necessitating high maintenance costs and long idle times during replacement.

FIGS. 3 to 7 of the attached drawings show schematically and by way of example different embodiments of the arcuate roller according to the invention.

FIG. 3 is an elevational view of an arcuate roller in partial crossection, showing also the development of the outside part of the joints or voids between the different sleeves.

FIG. 4 is a schematic view of the fixed central shaft of the arcuate roller shown in FIG. 3.

FIG. 5 shows in detail the surface of a sleeve.

Figure 1:
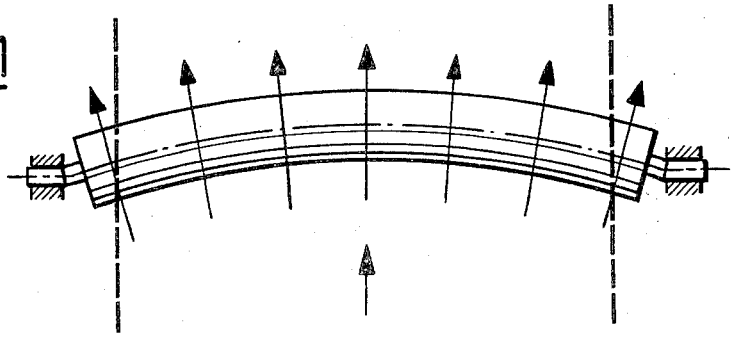
Figure 2:
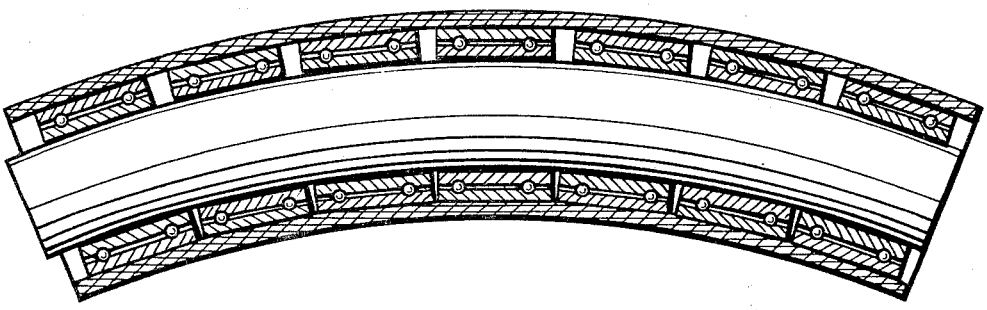

The web-spreading or arcuate roller shown in FIGS. 3 to 5 is entirely original and comprises a fixed central shaft 1 and rotatable sleeves 3 each idling on this central shaft.

The stationary central shaft 1 is made of a variable number of rings 2 mounted on a pretensioning curved rod. Its two end faces are machined in order to make a precise angle between them, which angle can vary according to the desired curvature.

The rings 2 are slid over the pretensioning rod then with tensioning devices 4 located on either side, the rings are pressed against each other. Due to the angle formed between the faces of each ring, the central shaft bends and is curved until the lateral faces of the rings 2 are completely applied to each other. Thus one obtains a central shaft comprising a deflection formed by very short rectilinear portions forming angles between them.

This central shaft comprises trunnions 5 at each end, the axes of which are aligned and each fixed in a support 6.

Each sleeve 3 rotates on only one ring 2 with two bearing surfaces on the length of said ring. Their rotation is obtained by a sliding bearing of synthetic material or other material or by means of ball bearings according to the use intended for the arched roller.

To avoid the use of an outside sleeve of rubber or another resilient material, the end faces of the modular sleeves are machined to form an angle, of for example 0° to 10°, with respect to the axis, the middle point being aligned on the axis. The sleeves are thus mounted beside each other, positive angle against negative angle, shifted by 180°.

This system of trapezoidal sleeves avoids the marking of the endless band while balancing the masses. The sockets are fast in rotation with each other, by means of pins for example, or by axial tensioning devices or resilient joints.

For the sleeves to revolve freely without braking action on the fixed rings forming the arc or a fraction of polygon, the sleeves just touch each other on the center side or concave side, whereas they are slightly spaced apart at the outer side.

The sleeves may be made of any material, metals, synthetic material, etc. Their outside surface is precisely machined to avoid any vibration of the roller.

It is evident that like sleeves 3 can be mounted on a rectilinear central shaft to obtain a straight roller.

In the case where smooth or sliding bearings are used, they may present helical grooves for oil circulation.

It is to be noted as seen in the lower part of FIG. 3, that the joints J have a sinusoidal development.

As illustrated in FIG. 5, chamfers 7 are provided on the edge of the sleeves in order to constitute grooves 8, which displace laterally and therefore do not mark the band, and which permits the escape of an air cushion which could be trapped between the roller and the band.

Figure 6:
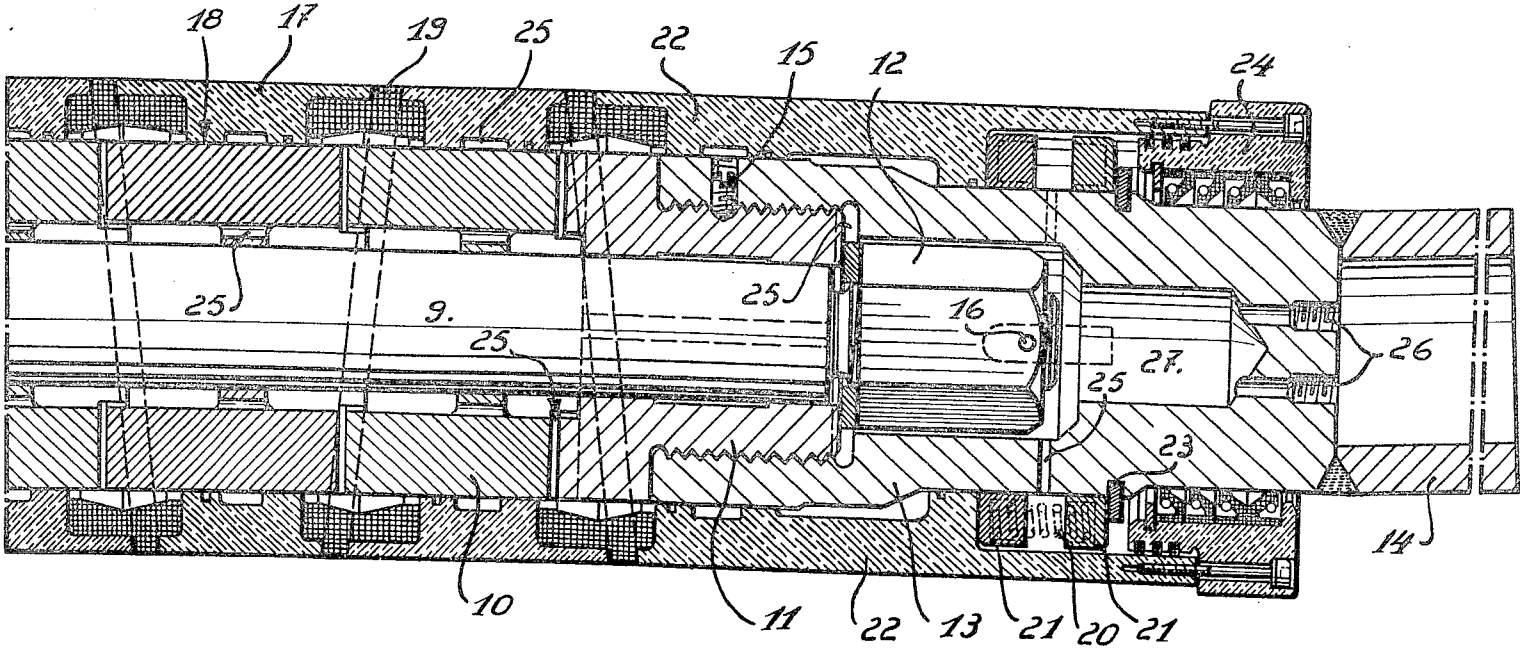
FIG. 6 shows, partly in crossection, a first embodiment of the roller.

FIG. 6 shows one embodiment of the roller according to the invention. In this embodiment, one finds again the pretensioning rod 9, threaded at each of its ends. Intermediate elements or shaft modules 10, of a general trapezoidal shape, are slid over the rod 9 and aligned as in the foregoing embodiment, so that their large side is aligned on one side. At each end of this assembly of intermediate elements 10 a tightening sleeve 11 is also slid over the rod 9, the free end of which is threaded.

By means of nuts 12 screwed on the threaded ends of the rod 9, the intermediate elements or shaft modules 10 can be tightened against each other and constitute the central cylindrical arcuate shaft formed by the pretensioning rod 9 and the rings or modules 10.

The angular position of the modules 10 with respect to each other is fixed, for example by means of pins, etc. Furthermore the ends of the central shaft are each provided with a trunnion carrier 13 screwed on the free threaded end of the tightening sleeve 11, and mounts a trunnion 14 fastened for example by welding, the two trunnions of each roller being coaxial. Therefore, the driving and control member for the roller, cooperating with the trunnions 14 can be mounted on them without forming an angle with the vertical.

Furthermore, the trunnion carrier 13 may be locked on the thread of the sleeve 11, by means of a screw 15 for example. Likewise, the nuts 12 can be locked onto the thread of the pretensioning rod 9, for example by means of a small pin 16 or a screw crossing the nut 12 and the thread of the rod 9, which permits one to obtain always the same positioning of the nut 12 on the said thread and therefore the same tightening of the modules 10 against each other on the pretensioning rod 9.

Trapezoidal sleeves 17 are fitted onto the outside surface of the central shaft and comprise flanges 18, the inner annular surface of which carries a slide bearing cooperating with the outside surface of the shaft modules 10.

In another embodiment (not shown), the sleeves 17 can be mounted on the central shaft by means of ball bearings.

Joints 19 of a resilient material and comprising an annular edge are located in the annular void between two adjacents sleeves 17. The joints 19 have thus a shape adapted to tightly seal the inside of the roller, in order to facilitate its lubrication, these joints 19 becoming more efficient the greater the rotation speed of the roller.

Furthermore, at least one end of this roller is provided with a compression device comprising springs 20 pressed between two rings 21, 21' tending to apply the sleeves against each other, one of the rings 21 resting on an annular shoulder of the end sleeve 22, the shape of which is different from the other sleeves, and the other 21' abutting against a ring 23 fast with the trunnion carrier 13.

Finally, the roller according to the invention is provided at each of its ends with a sealing cover 24 intended to tightly isolate the inside of this roller, in order to avoid that water or other liquids, contained in or on the endless bands to be treated, penetrate within the roller and damage the bearings or hinder their normal working. Furthermore, this tight construction permits the filling of the roller with an appropriate fluid, for example oil, intended to lubricate the different moving parts. Longitudinal and transverse baffle plates or grooves 25 can be provided as shown in FIG. 6 to obtain a forced circulation of the lubricating liquid inside the roller. Taps 26 for thermometer, manometer and so on can also be provided to control the circulation conditions of the lubricating fluid, these taps opening in a chamber 27 provided in the trunnion carrier 13 in the prolongation of the axis of the pretensioning rod.

For the circuit of lubricating fluid within the roller according to the invention, one can provide for a cooling device of this fluid as well as for a membrane device for compensating the volume changes due to the thermal expansion of this fluid.

The rotatable sleeve roller according to the present invention has the advantages, for the user, to be of simple design and use and to be economical. In fact, it can be easily dismantled and therefore the different elements are removable and exchangeable thus reducing the repair and transportation costs with respect to the known devices. Furthermore the idle times, for repair for example, are greatly reduced.

Figure 7:
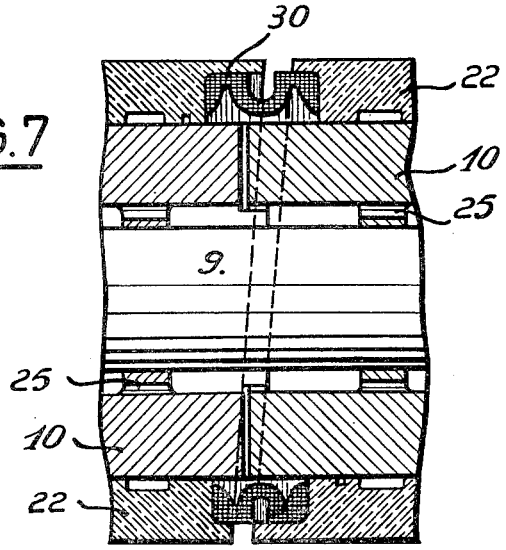
FIG. 7 is a partial crossection of a variant of the roller.

In the variant shown in FIG. 7, the roller is intended to be lubricated and cooled by a water circulation. To this effect, it can be provided at one end with a water inlet and at its other end with a water outlet, both connected to tapping which would be provided in the trunnion carriers 13. In this variant, the elements corresponding to those of the embodiment of FIG. 6 bear the same reference ciphers.

The annular joints 30 between each sleeve 22 have the general shape of an M seen in crossection. Thus the roller is watertight and the modification of the distance separating the sleeves 22 during their rotation is permitted. It is evident that in this variant the parts in contact with the cooling and lubricating water are of stainless steel or a material which is not corroded by water.

Of course many modifications can be provided by one skilled in the art to the device described by way of non-limitative example without departing from the scope of this invention.

I claim:

1. A web-spreading roller comprising a stationary central shaft and a plurality of cylindrical sleeves mounted for rotation thereon, said central shaft comprising a prestressed rod and a plurality of stationary cylindrical rings, the end faces of each of said rings being disposed in planes forming an acute angle with each other, the cylindrical rings being disposed on the prestressed rod with their long sides in alignment, said central shaft comprising further means tensioning said rod and compressing said rings against each other thereby imparting an arcuate shape to the central shaft.

2. A web-spreading roller as claimed in claim 1, and axially aligned trunnions at each end of said shaft.

3. A web-spreading roller as claimed in claim 1, in which said cylindrical sleeves have end faces disposed in planes forming an acute angle with each other, said sleeves being disposed on said arcuate shaft in alternately opposite orientation with a short side of each cylindrical sleeve in alignment with the long sides of the adjacent cylindrical sleeves.

4. A web-spreading roller as claimed in claim 3, and means interconnecting said sleeves for conjoint rotation on said shaft.

5. A web-spreading roller as claimed in claim 3, the lateral edges of said sleeves being chamfered to form grooves permitting the escape of air between the roller and a web carried by the roller.

6. A web-spreading roller as claimed in claim 3, and resilient joints between said sleeves sealing the spaces between said sleeves.

7. A web-spreading roller as claimed in claim 6, said joints having in transverse cross section the general shape of an M.

8. A web-spreading roller as claimed in claim 6, and a lubricating fluid within said sleeves.

9. A web-spreading roller as claimed in claim 8, said fluid being water or oil.

10. A web-spreading roller as claimed in claim 9, and inlet and outlet tappings for said fluid for fluid circulation serving both for the lubrication and for the cooling of the roller.

* * * * *